US008505439B2

(12) United States Patent
Gronau et al.

(10) Patent No.: US 8,505,439 B2
(45) Date of Patent: Aug. 13, 2013

(54) PNEUMATIC COMPONENT

(75) Inventors: Jens-Thorsten Gronau, Hameln (DE); Mike Heurich, Apelern (DE); Tino Wiggers, Seelze (DE)

(73) Assignee: WABCO GmbH, Hannover (DE)

( * ) Notice: Subject to any disclaimer, the term of this patent is extended or adjusted under 35 U.S.C. 154(b) by 849 days.

(21) Appl. No.: 12/452,245

(22) PCT Filed: Jun. 26, 2008

(86) PCT No.: PCT/EP2008/005217

§ 371 (c)(1),
(2), (4) Date: Feb. 17, 2010

(87) PCT Pub. No.: WO2009/012862

PCT Pub. Date: Jan. 29, 2009

(65) Prior Publication Data

US 2010/0189579 A1 Jul. 29, 2010

(30) Foreign Application Priority Data

Jul. 26, 2007 (DE) ..... 10 2007 034 978

(51) Int. Cl.
*F15B 15/20* (2006.01)
*F16J 15/32* (2006.01)

(52) U.S. Cl.
USPC ..... 92/247; 92/248

(58) Field of Classification Search
USPC ..... 92/247, 248
See application file for complete search history.

(56) References Cited

U.S. PATENT DOCUMENTS

| | | | | |
|---|---|---|---|---|
| 2,446,224 | A * | 8/1948 | Frisby et al. | 277/458 |
| 3,052,478 | A * | 9/1962 | Horvereid | 277/394 |
| 5,002,290 | A * | 3/1991 | Pernin | 277/649 |
| 6,848,354 | B2 * | 2/2005 | Grochowski | 92/249 |
| 6,883,804 | B2 * | 4/2005 | Cobb | 277/549 |
| 7,857,322 | B2 * | 12/2010 | Fietz | 277/566 |
| 2004/0056427 | A1 | 3/2004 | Rapp et al. | |
| 2005/0051407 | A1 * | 3/2005 | Derra et al. | 192/85 C |

FOREIGN PATENT DOCUMENTS

| | | | |
|---|---|---|---|
| DE | 1 035 425 | B | 7/1958 |
| DE | 197 04 250 | A1 | 8/1998 |
| DE | 103 49 917 | A1 | 5/2005 |
| FR | 2 404 768 | A | 4/1979 |
| GB | 971016 | A | 9/1964 |
| GB | 1 604 008 | | 12/1981 |

* cited by examiner

*Primary Examiner* — Thomas E Lazo
(74) *Attorney, Agent, or Firm* — Kramer Levin Naftalis & Frankel LLP

(57) ABSTRACT

A pneumatic component includes a cylinder, a piston running in the cylinder, and a grooved ring. The grooved ring seals the piston from the cylinder, and has a static side and a dynamic side. The static side of the grooved ring has at least two concentric microlips.

15 Claims, 3 Drawing Sheets

PNEUMATIC COMPONENT

FIELD OF THE INVENTION

The present invention generally relates to a pneumatic component comprising a cylinder, a piston running in the cylinder, and a grooved ring that seals the piston with respect to the cylinder and that has a static side and a dynamic side.

BACKGROUND OF THE INVENTION

Pneumatic components of the general type under consideration are used, for example, in the form of compressors, in particular as piston air compressors, in trucks or passenger cars. The compressor piston has a circumferential groove, in which a grooved ring engages. The grooved ring seals the piston with respect to the cylinder. In order to reduce the production cost, the compressor piston is in part produced by an injection molding process. In the course of this process, mold parting flash running in the longitudinal direction of the piston is left behind. This mold parting flash must be removed by a machining process in order to be able to draw separately produced rubber grooved rings onto the piston. Without removal of the mold parting flash, the grooved ring does not sit sufficiently tightly on the piston. A disadvantage of such conventional pneumatic components is therefore their complicated manufacture.

In an alternative production process, in order to make the removal of the mold parting flash unnecessary, the rubber ring is first vulcanized in a seated position on the piston. A disadvantage of this is that, for piston diameters of more than 70 mm, this process has such a low degree of reliability that it cannot be used in the course of mass production.

SUMMARY OF THE INVENTION

It is an object of the present invention to overcome the disadvantages associated with conventional pneumatic components. This object is achieved by embodiments of the present invention in which the grooved ring has at least two concentric microlips on its static side.

An advantage of this construction is that the piston can be made of plastic by injection molding, for example, without the mold parting flash having to be removed. This is because the microlips, despite mold parting flash, provide for an airtight connection between the piston and the grooved ring. The grooved rings can be advantageously produced separately even at a diameter of more than 70 mm and can subsequently be connected to an injection-molded piston.

In addition, advantageously, a high degree of tightness can be achieved despite the presence of mold parting flash, and therefore sealing grease can largely be dispensed with.

In the present description, the dynamic side refers to that side of the grooved ring that rubs on another component during operation of the pneumatic component. The static side, on the other hand, is that side that, during operation of the pneumatic component, rests relative to the component to which the grooved ring is attached.

In a preferred embodiment, the grooved ring is fastened to the piston such that its static side faces the piston. The advantage thereof is that the piston can be produced from plastic in an injection molding process without the complications of having to remove the mold parting flash, which is unavoidably produced in the process. Producing the piston from plastic results in a piston that is especially easy and simple to produce.

Desirably, the grooved ring is fastened to the piston such that the mold parting flash intersects the microlips. If the mold parting flash runs, for example, in the longitudinal direction of the piston, it is advantageous if the microlips intersect the mold parting flash substantially perpendicularly.

For a good sealing effect with, at the same time, reliable retention of the grooved ring on the piston, it is preferred that the microlips project by less than 0.5 mm beyond a base area.

It is particularly advantageous if the piston has a diameter of more than 70 mm. In this case, the pneumatic component can be constructed with an especially large swept volume without the mold parting flash having to be removed. At such diameters, vulcanizing the grooved ring in place is no longer possible.

It is desirable that the grooved ring be made of rubber since such grooved rings have an especially long service life.

An especially good sealing effect is achieved if the grooved ring has multiple concentric microlips, for example 3, 4, 5 or more microlips.

A pneumatic component according to the embodiments of the present invention can be used as an air compressor, in particular for a pneumatic system of a utility vehicle. Alternatively, a pneumatic component according to the inventive embodiments can be used as a pneumatic actuator, in particular as a pneumatic gearshift control.

Still other objects and advantages of the present invention will in part be obvious and will in part be apparent from the specification.

The present invention accordingly comprises the features of construction, combination of elements and arrangement of parts, all as exemplified in the constructions herein set forth, and the scope of the invention will be indicated in the claims.

BRIEF DESCRIPTION OF THE DRAWINGS

For a fuller understanding of the present invention, reference is had to the following exemplary embodiments, which are discussed in greater detail hereinafter with reference to the attached drawings, in which.

DETAILED DESCRIPTION OF THE PREFERRED EMBODIMENTS

Figure 1:
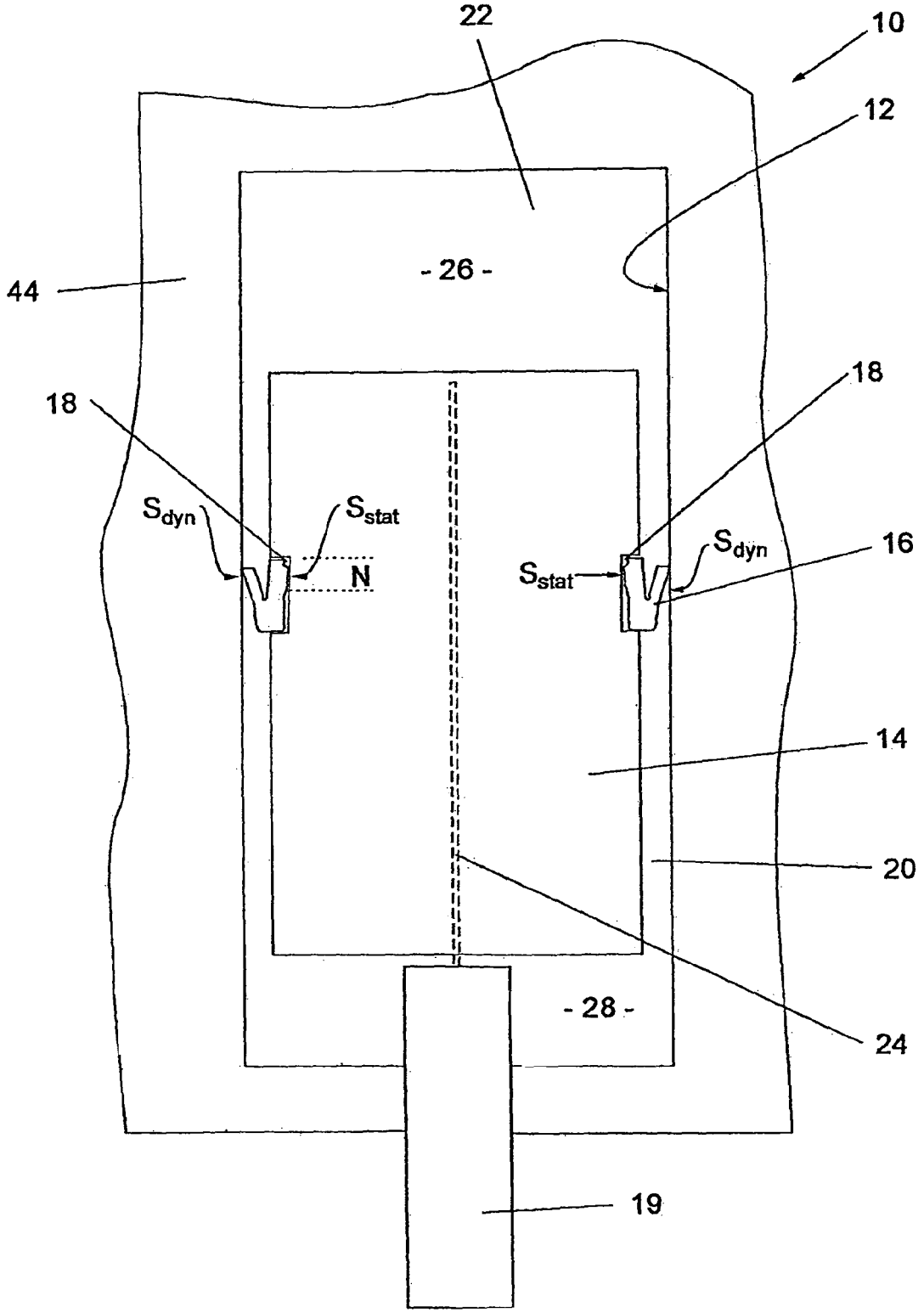
FIG. 1 is a schematic cross section through a pneumatic component according to an embodiment of the present invention.

Referring now to the drawing figures, FIG. 1 shows a pneumatic component in the form of a compressor 10 that includes a cylinder 12, a piston 14 running in the cylinder 12, and a grooved ring 16. The grooved ring 16 is fixedly fastened in a circumferential groove 18 around the piston 14. The piston 14 is movable in a reciprocating manner on a connecting rod 19. If the piston 14 is pushed into the cylinder 12, the grooved ring 16 seals a gap 20 between the cylinder 12 and the piston 14, so that air 22 located in the cylinder 12 is compressed to an air pressure p. The compressed air is discharged from the cylinder by a check valve (not depicted), and, during the movement of the piston 14 out of the cylinder 12, air can flow past the grooved ring 16 through the gap 20 in order to be compressed during a subsequent stroke.

The piston 14 is made of plastic by an injection molding process, which has resulted in demolding flash 24, which is depicted schematically by broken lines and extends along a longitudinal axis of the piston 14 and also runs through the groove 18. In order to separate a pressure space 26 from a suction space 28 of the cylinder 12 in an airtight manner, the grooved ring 16 must also bear flush against the piston 14 in the region of the mold parting flash 24. To this end, it has microlips on its static side $S_{stat}$, as shown in detail in FIG. 2. Microlips can also be provided on its dynamic side $S_{dyn}$, but are not provided in the present case.

Figure 2:
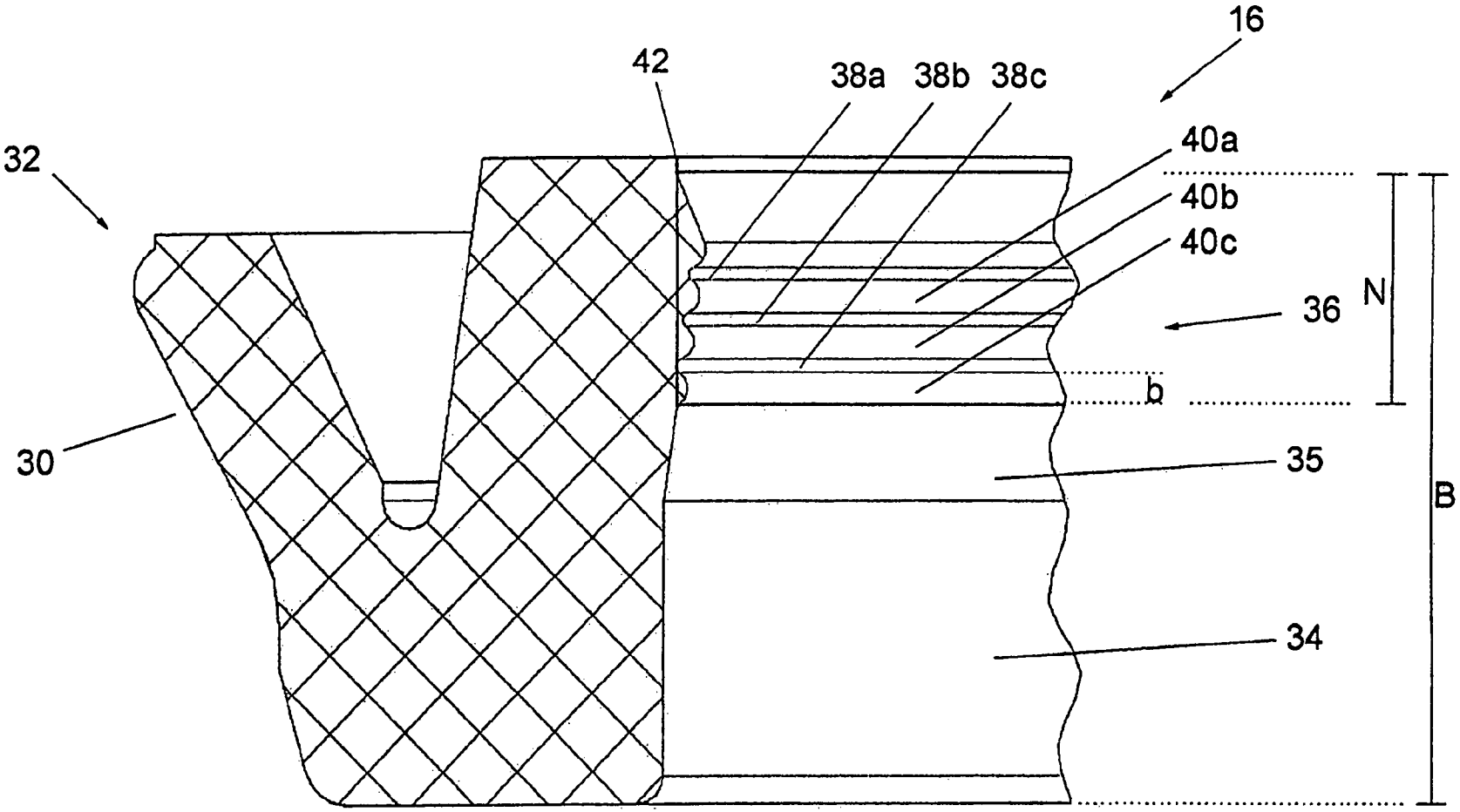
FIG. 2 shows a grooved ring of a pneumatic component according to an embodiment of the present invention.

FIG. 2 shows the grooved ring 16 in a detailed view. The grooved ring 16 has a sealing lip 30 of substantially constant thickness. The sealing lip 30 lies radially on the outside and has a rounded-off portion at its radially outermost edge 32. At its end remote from the edge 32, the grooved ring 16, which is of substantially V-shaped design, merges into a bearing section 34 in the shape of a cylinder barrel with which it bears against the piston 14 in the groove 18. The bearing section 34 has an axial extent that corresponds substantially to half an axial extent of the grooved ring 16. The inside diameter of the grooved ring 16 in the bearing section 34 is such that it bears without play and with slight force against the piston.

Adjoining the bearing section 34 is a transition section 35 that projects radially inwards and merges into an engagement section 36. At the transition to the engagement section 36, the transition section 35 has a diameter such that it bears with a sufficiently high pressure against the piston 12 (FIG. 1) in order to seal the pressure space 26 with respect to the suction space 28 at the air pressure p, provided the demolding flash 24 is removed. For example, the diameter is 100 μm to 1 mm smaller than the inside diameter of the bearing section 34.

In order to remove the tightness-preventing effect of the demolding flash 24, microlips 38*a*, 38*b*, 38*c*, 38*d* pointing radially inward are formed in the engagement section 36, the microlips 38*a*, 38*b*, 38*c*, 38*d* being separated from one another by respective lip roots 40*a*, 40*b*, 40*c*. The microlips 38 project by 0.1 mm to 0.7 mm beyond a base area 42 in the shape of a cylinder barrel and run through the lip roots 40*a*, 40*b*, 40*c*. The microlips 38 all have substantially the same cross-sectional contour and are arranged concentrically to one another. The microlips have a microlip width b that is less than one tenth of the width B of the grooved ring 16. For example, the microlip width b is less than 1 mm and in particular greater than 0.1 mm. In addition, the microlip width is advantageously less than one fourth of a width N of the engagement section 36 (FIG. 1).

Figure 3:
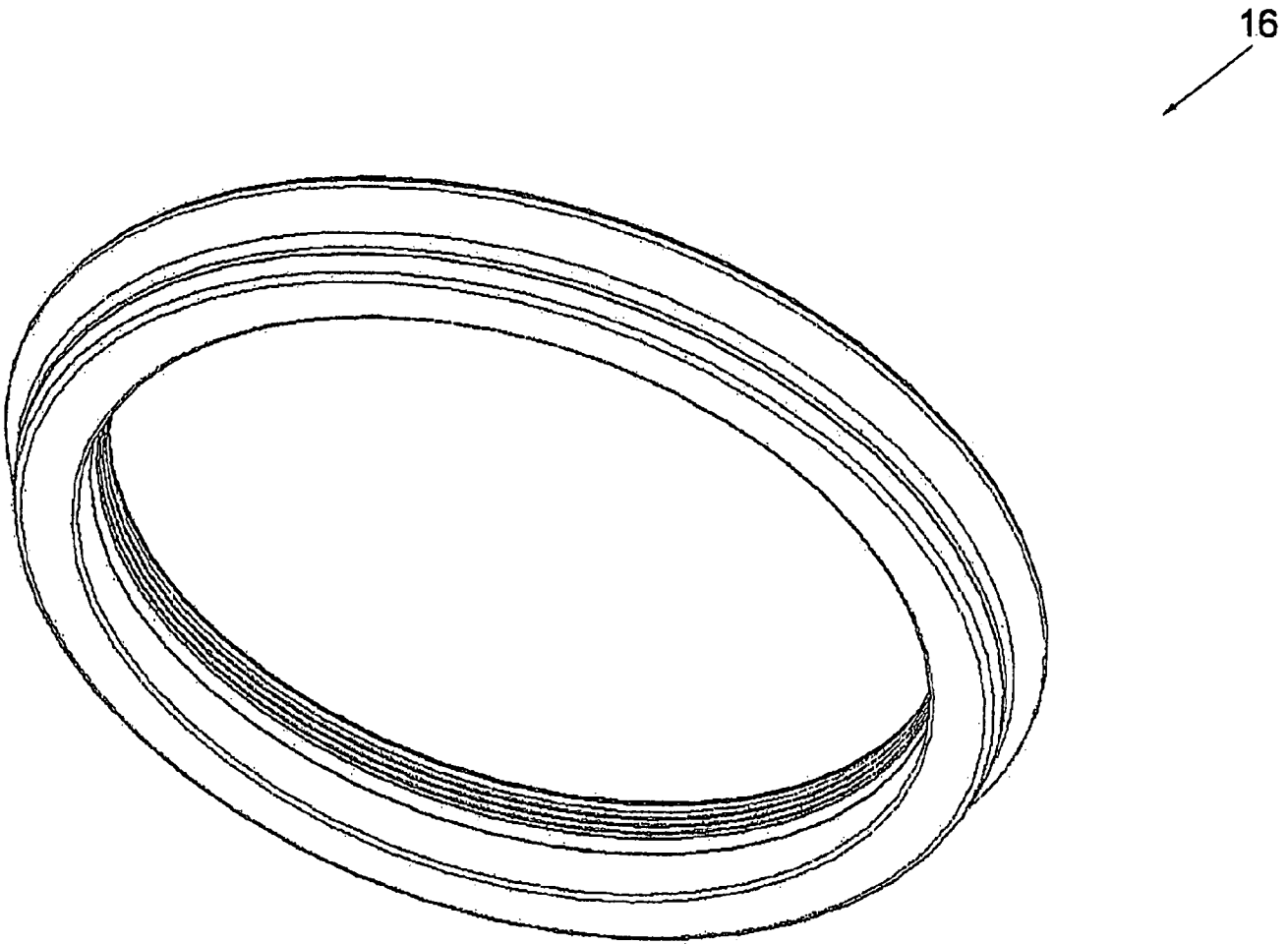
FIG. 3 is a three-dimensional view of a grooved ring for a pneumatic component according to an embodiment of the present invention.

FIG. 3 shows the grooved ring 16 in a three-dimensional view.

To produce the compressor 10, the piston 14 is injection molded and a cylinder casing 44 is produced, which is shown schematically in FIG. 1 and in which cylinders 12 are formed. In addition, the grooved ring 16 is made of rubber and is in particular vulcanized in the process. The grooved ring 16 is then drawn over the piston 14, which is re-worked without chip removal after the injection molding, and is placed in the groove 18. The components are then combined with further construction elements, such as, for example, a belt pulley for driving the connecting rod 19, to build a compressor.

Alternatively, the pneumatic component can also be a pneumatic cylinder. In this case, the connecting rod 19 functions as a push rod. By the admission of compressed air to the pneumatic cylinder, the push rod is pushed out of the cylinder casing 44 and actuates a component to be shifted or moved.

It will thus be seen that the objects set forth above, among those made apparent from the preceding description, are efficiently attained, and since certain changes may be made without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention that, as a matter of language, might be said to fall therebetween.

What is claimed is:

1. A pneumatic component, comprising:

a cylinder;

a piston in said cylinder, wherein said piston comprises a longitudinal mold parting flash; and a grooved ring sealing said piston with respect to said cylinder, said grooved ring including a static side and a dynamic side, said static side having at least two concentric microlips, wherein said grooved ring is fastened to said piston with said longitudinal mold parting flash intersecting said at least two concentric microlips.

2. The pneumatic component as claimed in claim 1, wherein said grooved ring is fastened to said piston with said static side facing said piston.

3. The pneumatic component as claimed in claim 1, wherein said piston is made of plastic.

4. The pneumatic component as claimed in claim 3, wherein said piston is injection-molded.

5. The pneumatic component as claimed in claim 1, wherein said at least two concentric microlips project by less than 0.5 mm beyond a base area.

6. The pneumatic component as claimed in claim 1, wherein said piston has a diameter greater than 70 mm.

7. The pneumatic component as claimed in claim 1, wherein said grooved ring is made of rubber.

8. The pneumatic component as claimed in claim 1, wherein said grooved ring has more than two concentric microlips.

9. The pneumatic component as claimed in claim 1, wherein said pneumatic component is an air compressor for a pneumatic system of a utility vehicle.

10. The pneumatic component as claimed in claim 1, wherein said pneumatic component is a pneumatic actuator for a pneumatic gearshift control.

11. The pneumatic component as claimed in claim 1, wherein said at least two concentric microlips perpendicularly intersect the longitudinal mold parting flash.

12. The pneumatic component as claimed in claim 1, wherein said grooved ring is v-shaped and comprises:

a bearing section at an apex of said grooved ring;

a transition section on said static side, said transition section contiguous with said bearing section;

an engagement section on said static side, said transition side contiguous with said bearing section; and a sealing lip on said dynamic side, said sealing lip contiguous with said bearing section and separated from said transition section and said engagement section.

13. The pneumatic component as claimed in claim 12, said at least two concentric microlips being formed on said engagement section.

14. A method of producing a pneumatic component, comprising the steps of:

(a) producing a cylinder casing in which a cylinder is formed;

(b) injection molding a piston having a radially circumferential groove and a longitudinal mold parting flash;

(c) producing a grooved ring having a static side and a dynamic side, said static side having at least two concentric microlips; and (d) inserting said grooved ring into said groove, said longitudinal mold parting flash intersecting said at least two concentric microlips.

15. The method as claimed in claim 14, wherein said piston is made of plastic.

* * * * *

UNITED STATES PATENT AND TRADEMARK OFFICE

CERTIFICATE OF CORRECTION

PATENT NO. : 8,505,439 B2
APPLICATION NO. : 12/452245
DATED : August 13, 2013
INVENTOR(S) : Gronau et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 872 days.

Signed and Sealed this
Fifteenth Day of September, 2015

Michelle K. Lee

Michelle K. Lee
*Director of the United States Patent and Trademark Office*